United States Patent [19]

Mulligan

[11] 4,424,133

[45] Jan. 3, 1984

[54] FIRE-FIGHTING COMPOSITIONS

[75] Inventor: David J. Mulligan, Bentham Lancaster, England

[73] Assignee: Angus Fire Armour Limited, Thame, England

[21] Appl. No.: 304,642

[22] Filed: Sep. 22, 1981

[30] Foreign Application Priority Data

Sep. 30, 1980 [GB] United Kingdom ..... 8031466

[51] Int. Cl.[3] ..... A62C 1/00; A62D 1/00

[52] U.S. Cl. ..... 252/8.05; 169/47; 252/2; 252/3

[58] Field of Search ..... 169/45, 46, 47; 252/2, 252/3, 8.05

[56] References Cited

U.S. PATENT DOCUMENTS

| | | | |
|---|---|---|---|
| 3,475,333 | 11/1967 | Meldrum et al. . | |
| 4,060,132 | 11/1977 | Chiesa, Jr. . | |
| 4,099,574 | 7/1978 | Cooper et al. | 252/8.05 |
| 4,209,407 | 6/1980 | Schuierer et al. | 252/8.05 |
| 4,278,552 | 7/1981 | Hisamoto et al. | 252/8.05 |

FOREIGN PATENT DOCUMENTS

| | | | |
|---|---|---|---|
| 814905 | 6/1969 | Canada . | |
| 2749331 | 5/1979 | Fed. Rep. of Germany | 252/8.05 |
| 2308674 | 11/1976 | France . | |
| 1245124 | 9/1971 | United Kingdom . | |
| 1270838 | 4/1972 | United Kingdom . | |
| 1280508 | 7/1972 | United Kingdom . | |
| 1355601 | 6/1974 | United Kingdom . | |
| 1415400 | 11/1975 | United Kingdom . | |
| 1518752 | 7/1978 | United Kingdom . | |
| 1566724 | 5/1980 | United Kingdom . | |

*Primary Examiner*—Leland A. Sebastian

*Attorney, Agent, or Firm*—Stevens, Davis, Miller & Mosher

[57] ABSTRACT

The invention is a composition for combating fires and for inhibiting release of flammable vapor from liquids, which is film-forming and comprises, in an aqueous medium, a blend of a hydrolyzed protein and an ampholytic sulphonamide fluorosurfactant falling within the general formula:

$$C_6F_{13}.(CH_2)_2.SO_2.N(H \text{ or } CH_3).(CH_2)_2 \text{ or } {}_{3}.N^{30}(CH_3)_2.(CH_2)_{1\text{-}3}.COO-,$$

said fluorosurfactant, when as a 0.1% aqueous solution, being film-forming on cyclohexane at normal temperatures. The composition preferably has an interfacial tension on 4-star petrol of at least 3.5 dyn.cm$^{-1}$ and is particularly suitable for employment in foam form.

17 Claims, No Drawings

FIRE-FIGHTING COMPOSITIONS

This invention relates to fire-fighting compositions and particularly to compositions for use in preventing or inhibiting the release of flammable vapours from liquids and for use in combating fires on flammable liquids.

Foamable fire-fighting compositions based on an aqueous blend of a fluorosurfactant and a hydrolysed protein, so-called "fluoroprotein" compositions, are known. The best fluoroprotein compositions available commercially prior to the present invention provide superior security against re-ignition but have inferior flame extinction, i.e. knock down, when compared to aqueous film-forming foams based on synthetic surfactants, particularly fluorosurfactants, known as "AFFF" compositions. The best commercially available AFFF compositions, on the other hand, have superior knock-down properties and provide vapour securing films on most flammable fuels but have inferior post-extinction security, especially on hot fires, when compared to the best fluoroprotein compositions. Thus, fluoroprotein compositions were preferred for some fire situations and AFFF compositions for others.

It is now discovered that, by a particular selection of fluorosurfactant, a fluoroprotein composition can be produced which possesses the superior properties of both the known fluoroprotein compositions and the AFFF compositions.

According to the present invention, therefore, there is provided a fire-fighting film-forming composition which comprises in an aqueous medium a blend of a hydrolysed protein and an ampholytic sulphonamide fluorosurfactant falling within the general formula:

$$C_6F_{13}\cdot(CH_2)_2\cdot SO_2\cdot N(H \text{ or } CH_3)\cdot(CH_2)_{2\text{ or }3}\cdot N^+(CH_3)_2\cdot(CH_2)_{1\text{-}3}\cdot COO^-,$$

said fluorosurfactant, when as a 0.1% aqueous solution, being film-forming on cyclohexane at normal temperatures.

The particularly preferred fluorosurfactant for employment in the present invention is that available under the trade name Forafac 1157 which is a 27% active (solids) solution of fluorosurfactant in 50/50 methanol/-water. The usefulness of this fluorosurfactant is particularly surprising since the fluorosurfactant available under the trade name Forafac 1116, which has a very similar chemical formula to that of Forafac 1157, is not suitable for use in the present invention.

The fluorosurfactant of Forafac 1116 is believed to have the formula:

$$C_6F_{13}\cdot(CH_2)_2\cdot SO_2\cdot NH\cdot(CH_2)_3\cdot N^{+/}(CH_3)_2\cdot(CH_2)_2\cdot COO^-.$$

When in the form of a 0.1% aqueous solution this fluorosurfactant does not form a film on cyclohexane at normal temperatures (such as 10°–25° C.). In contrast, 0.1% aqueous solution of the fluorosurfactant of Forafac 1157 does form a film on cyclohexane at normal temperatures. It is found also that the storage stability of fluoroprotein compositions based on Forafac 1116 is significantly inferior to that of fluoroprotein compositions based on Forafac 1157. The formula of the fluorosurfactant in Forafac 1157 is believed to be:

$$C_6F_{13}\cdot(CH_2)_2\cdot SO_2\cdot NH\cdot(CH_2)_3\cdot N^+(CH_3)_2\cdot CH_2\cdot COO^-.$$

The amount of fluorosurfactant in the composition as applied to a flammable liquid is preferably at least 0.015 part by weight per 100 parts by weight of the composition. The upper limit on the amount of fluorosurfactant is dependant mainly on economical and practical considerations. A suitable upper limit is 0.15 part by weight of fluorosurfactant per 100 parts by weight of the composition. Usually the composition is stored in concentrated form and is diluted with water, and usually foamed, immediately prior to application to a fire. For instance, the amount of Forafac 1157 in the concentrate is preferably from 1.5 to 10 parts by weight per 100 parts by weight of concentrate. However, if an additional surfactant is present in the composition, the amount of the fluorosurfactant as defined above may be reduced.

Hydrolysed proteins for use in fire-fighting compositions are well known. They are made by hydrolysing substances such as keratins and albumens which are found in animal hooves, horns, feathers and blood. They are employed as aqueous compositions (bases) which often contain one or more additives such as stabilisers, preservatives and complexing agents, e.g. iron salts, zinc salts, sodium citrate and sodium chloride, all of which are known additives to improve solution-stability and fire-fighting properties such as foam-stability, heat-resistance and foam-drainage.

The hydrolysed protein bases employed in the present invention usually have a pH of less than 9, e.g. from 6 to 8. The amount of hydrolysed protein present in the composition as applied to a fire suitably is in the range of from 0.3 to 3.0 parts by weight (solids) per 100 parts by weight of the composition. In the concentrate form of the composition the amount of hydrolysed protein base present may be, for example, from 30 to 90 per cent by weight of the concentrate, and the concentration of hydrolysed protein in the hydrolysed protein base may be, for example, from 20 to 25% weight/volume in a 6% concentrate, and from 35 to 45% weight/volume in a 3% concentrate. By 6% and 3% concentrates is meant that the concentrates are formulated for dilution with 94 and 97 parts by volume of water, respectively, to produce the composition to be applied to a fire.

The composition of the invention is film-forming, i.e. it passes the film-formation test on cyclohexane at room temperature as described in U.S. Military Specification MIL-F-24385B dated 25 May 1978.

It is found that the interfacial tension between the composition and the flammable liquid to which it is applied is particularly important. It is found that the composition preferably should have a minimum interfacial tension of 3.5 $dyn.cm^{-1}$ on standard United Kingdom 4-star petrol (British Standard Specification 4040 of 1978having a surface tension of $20\pm0.5$ $dyn.cm^{-1}$. It is found that below this level the applied composition, particularly when in foam form, is contaminated by the flammable liquid to such an extent that the fire-fighting properties of the composition are diminished to an unacceptable level. Accordingly it is preferred that fluorine-free surfactants (also known as hydrocarbon surfactants) are substantially absent from the composition since such surfactants usually result in an undesirable reduction of interfacial tension. By "substantially absent" there is meant the absence of an amount sufficient to affect significantly the fire-fighting properties of the composition (e.g. film-formation, flame knockdown, burnback resistance or foam drainage rate). Preferably the composition is completely free of fluorine-free surfactant.

The composition preferably contains a foam booster. A preferred foam booster is hexylene glycol but other examples of foam boosters are isopropyl alcohol, butyl carbitol (butyl glycol or butyl oxitol) and butyl cellosolve. A suitable range of proportions of foam booster in the composition is from 2 to 40, especially from 2 to 15, parts by weight per 100 parts by weight of hydrolysed protein.

When the composition is for use on hydrophilic polar solvents such as alcohols and ketones, preferably it includes a hydrophilic polymeric foam-stabiliser such as a polysaccharide, especially an anionic heteropolysaccharide such as a xanthan gum having a high molecular weight, e.g. Actigum CX9. Usually such a polysaccharide improves the stability of the foam and thereby decreases the drainage rate. Only a small amount is required to confer a noticeable change in properties, e.g. an amount of less than 1% by weight based on the composition as applied to the flammable solvent may be employed.

Other ingredients which are usually employed in fire-fighting compositions may be employed in the composition of the invention. Examples of such ingredients are freezing point depressants such as ethylene glycol and preservatives such as that available under the trade name Glokill.

The amount of water present in the composition should be sufficient to dissolve at least the normally solid ingredients of the composition and usually the only water present in the concentrate form of the composition is that of the hydrolysed protein base and possibly also that of the commercially obtained fluorosurfactant solution.

The composition of the present invention is employed in the usual way to prevent or inhibit the release of flammable vapours or to combat fires on flammable liquids. The composition is particularly suitable for application in the form of a foam. Usually it is stored in the form of an aqueous concentrate requiring only dilution with water (to form the "pre-mix"and aeration to produce a foam which is applied to the flammable liquid surface. It is suitable for dilution with either fresh or sea water.

The typical composition as applied is compatible with conventional fire-fighting foam compositions and with conventional dry powder fireextinguishing agents and is suitable for application by twin-agent appliances. It can be applied by standard low- and medium-expansion foam-generating apparatuses. It is suitable for application by hand-held and fixed spray-appliances and, as a result of its high resistance to contamination by flammable liquid hydrocarbon fuels and good foam stability, it can be applied to such fuels by injection of the foamed composition into the base of the fuel container. Thus it is acceptable for use in a wide range of fire situations.

The invention is illustrated in the following Examples, in which all "parts" are by volume unless otherwise stated.

EXAMPLE I

The following compositions were prepared.

| | Parts | |
|---|---|---|
| | A | B |
| Forafac 1157 (27% active) | 0 | 3.3 |
| Forafac 1116 (40% active) | 2.5 | 0 |
| Butyl oxitol | 10 | 10 |
| Hydrolysed protein base | 80 | 80 |
| Added water | 7.5 | 6.7 |
| | 100 | 100 |

The amounts of the Forafacs are sufficient to provide a 0.9% concentration of the active fluorosurfactant in the total composition.

The fire performances of these 6% premixes were tested on Avgas according to the United Kingdom Government Defence Specification DEF 42-24. The results were as follows.

| | A | B |
|---|---|---|
| Foam expansion (%) | 9.8 | 10.0 |
| 25% drainage time (min) | 5.3 | 4.75 |
| Foam cover (sec) | 24 | 25 |
| 90% control of fire (sec) | 34 | 30 |
| Extinction time (sec) | 60 | 40 |
| Burnback time (min) | 9.9 | 10.9 |

The film-formation of each of these 6% premix compositions was tested by placing a spot of the composition carefully on the surface of various hydrocarbon fuels at room temperature. The results were as follows.

| | A | B |
|---|---|---|
| Cyclohexane | No film | Pronounced film |
| 4-Star petrol (S.T. = 20 ± 0.5 dyn · $cm^{-1}$) | Very slight film | Pronounced film |
| Avgas | No film | Very slight film |
| Avtur | No film | Pronounced film |

Both compositions had interfacial tensions of more than 4 dyn.$cm^{-1}$ on standard United Kingdom 4-star petrol having a surface tension of 20±0.5 dyn.$cm^{-1}$. However, as can be seen from the above results, the composition containing Forafac 1157 was film-forming but the composition containing Forafac 1116 was not.

EXAMPLE II

The following compositions were prepared.

| | Parts | |
|---|---|---|
| | C | D |
| Forafac 1157 (27% active) | 0 | 2.7 |
| Forafac 1116 (40% active) | 2.0 | 0 |
| Hexylene glycol | 10 | 10 |
| Actigum CX9 | 0.75 | 0.75 |
| Hydrolysed protein liquor | 57 | 57 |
| Added water | 30.25 | 29.55 |
| | 100 | 100 |

The parts of Actigum CX9 are by weight.

The amounts of the Forafacs are such that the same amount (0.73%) of active fluorosurfactant is present in each formulation.

Both compositions had interfacial tensions of more than 4 dyn.cm$^{-1}$ on standard United Kingdom 4-star petrol having a surface tension of 20±0.5 dyn.cm$^{-1}$.

The following properties were exhibited before and after storage for 12 days at 60° C.

| | C | | D | |
|---|---|---|---|---|
| | initial | 12 days | initial | 12 days |
| Foam expansion (%) | 8.2 | 3.7 | 8.0 | 8.7 |
| 25% drainage time (min) | 4.8 | 3.3 | 4.75 | 5.0 |

These results show the very good storage stability of the Forafac 1157 composition in contrast to the poor storage stability of the Forafac 1116 composition.

EXAMPLE III

Two concentrates were made according to the following formulations:

| | Parts | |
|---|---|---|
| | E | F |
| Forafac 1157 (27% solids) | 3.5 | 3.5 |
| Fluorine-free surfactant (30% solids) | 0 | 3 |
| Hydrolysed protein base (34% solids) | 96.5 | 93.5 |

The fluorine-free surfactant was an alkyl amido propyl dimethyl amine betaine sold under the trade name Empigen BT.

The two concentrates were tested as solutions containing 6 parts of concentrate to 94 parts of water according to the following procedure.

9 litres of standard United Kingdom 4-star petrol having a surface tension of 20±0.5 dyn.cm$^{-1}$ were placed in a 0.25 m$^2$ round fire tray and ignited. After 60 seconds a foam branchpipe delivering 2.25 litres per minute of solution was directed at the centre of the fire for one minute.

The results are shown below:

| E | F |
|---|---|
| Fire extinguished 7 seconds after terminating foam application | Fire not extinguished and foam burnt to complete destruction |

The test was repeated without lighting the petrol, and foam and solution samples were collected for analysis, yielding the following results:

| | E | F |
|---|---|---|
| Interfacial tension (dyn · cm$^{-1}$) | 4.9 | 2.5 |
| Petrol in foam sample (%) | 11 | 42 |

The action of the fluorine-free surfactant was to reduce interfacial tension, increase fuel contamination, and thus to impair fire performance.

EXAMPLE IV

A concentrate was made up according to the following formulation:

| | G |
|---|---|
| Forafac 1157 (27% solids) | 4 parts |
| Hydrolysed protein base (34% solids) | 96 parts |

Two controlled-discharge foam extinguishers were each filled with 10 litres of solution made from 1 part of concentrate plus 9 parts of water.

450 litres of aviation grade kerosene (Avtur) were poured into a 37 m$^2$ square bund containing a water base and were ignited. When the fuel was fully involved in flames the fire was tackled by two operators with the two extinguishers, spreading the foam as widely as possible on the fire. The fire was fully extinguished in 70 seconds, at the exceptionally low foam application rate of 0.5 1/m$^2$/min.

EXAMPLE V 2250 litres of aviation grade kerosene (Avtur) were placed in an 81 m$^2$ bund on a water base and ignited. After 60 seconds of burning, a solution made from 6 parts of concentrate G to 94 parts of water was applied as a foam spray to the fire by an operator using a portable branchpipe delivering 160 litres of solution per minute. The fire was fought in an aggressive manner, spreading the foam as widely as possible.

The results of this test are shown below in comparison with typical data for synthetic aqueous film-forming foam (AFFF) in this test.

| | G | AFFF |
|---|---|---|
| Fire control time (sec.) | 15 | 20 |
| Fire extinction time (sec.) | 18 | 24 |

Concentrate G showed a clear superiority over AFFF in this severe fire test which simulates an aircraft crash situation.

I claim:

1. A fire-fighting film-forming composition which comprises in an aqueous medium a blend of a hydrolysed protein and an ampholytic sulphonamide fluorosurfactant falling within the general formula:

$$C_6F_{13}\cdot(CH_2)_2\cdot SO_2\cdot N(H \text{ or } CH_3)\cdot(CH_2)_2 \text{ or } 3\cdot N^+(CH_3)_2\cdot(CH_2)_{1\text{-}3}\cdot COO^-,$$

said fluorosurfactant, when as a 0.1% aqueous solution, being film-forming on cyclohexane at normal temperatures, said composition being substantially free of fluorine-free surfactants.

2. A composition according to claim 1 wherein the amount of the fluorosurfactant in the composition in concentrate form is from 1.5 to 10 parts by weight per 100 parts by weight of concentrate.

3. A composition according to claim 1 wherein the fluorosurfactant has the formula:

$$C_6F_{13}\cdot(CH_2)_2\cdot SO_2\cdot NH\cdot(CH_2)_3\cdot N^+(CH_2)_2\cdot CH\text{-}_2\cdot COO \text{ hu } -.$$

4. A composition according to claim 1 having a minimum interfacial tension of 3.5 dyn.cm$^{-1}$ on standard United Kingdom 4-star petrol having a surface tension of 20±0.5 dyn.cm$^{-1}$.

5. A composition according to claim 1 wherein the amount of the fluorosurfactant present in the composition for application to a flammable liquid is at least 0.015 part by weight per 100 parts by weight of the composition.

6. A composition according to claim 1 wherein the amount of the fluorosurfactant in the composition for application to a flammable liquid is up to 0.15 part by weight per 100 parts by weight of the composition.

7. A composition according to claim 1 wherein the amount of the hydrolysed protein in the composition for application to a flammable liquid is from 0.3 to 3.0 parts by weight (solids) per 100 parts by weight of the composition.

8. A composition according to claim 1 wherein the amount of hydrolysed protein base in the concentrate form of the composition is from 30 to 90% by weight of the concentrate.

9. A composition according to claim 1 containing hexylene glycol.

10. A composition according to claim 1 containing a hydrophilic polymeric foam-stabiliser.

11. A composition according to claim 10 wherein the foam-stabiliser is an anionic heteropolysaccharide.

12. A composition according to claim 11 wherein the heteropolysaccharide is a xanthan gum.

13. A composition according to claim 11 wherein the amount of the foam-stabiliser is less than 1% by weight based on the composition for application to a flammable liquid.

14. A composition according to claim 1 which is for application in foam form to a flammable liquid.

15. A method of preventing or inhibiting the release of a flammable vapour from a liquid or combating a fire on a flammable liquid which comprises applying to the liquid surface a composition according to claim 1.

16. A method according to claim 15 wherein the composition is applied in foam form.

17. A method according to claim 16 wherein the foamed composition is applied by injection beneath the liquid surface.

* * * * *